US007611419B2

(12) United States Patent
O'Neill

(10) Patent No.: US 7,611,419 B2
(45) Date of Patent: Nov. 3, 2009

(54) GOLF CLUB

(75) Inventor: Kevin O'Neill, Torquay (AU)

(73) Assignee: Australian Putter Co Pty Ltd (AU)

( * ) Notice: Subject to any disclaimer, the term of this patent is extended or adjusted under 35 U.S.C. 154(b) by 0 days.

(21) Appl. No.: 12/099,805

(22) Filed: Apr. 9, 2008

(65) Prior Publication Data

US 2008/0261718 A1 Oct. 23, 2008

Related U.S. Application Data

(60) Provisional application No. 60/912,212, filed on Apr. 17, 2007.

(51) Int. Cl.
*A63B 69/36* (2006.01)

(52) U.S. Cl. ..... 473/242; 473/251; 473/253; 473/254

(58) Field of Classification Search ..... 473/219–256; D21/736–746
See application file for complete search history.

(56) References Cited

U.S. PATENT DOCUMENTS

| | | | | | |
|---|---|---|---|---|---|
| D229,622 | S | * | 12/1973 | Bartron | D21/738 |
| 3,880,430 | A | | 4/1975 | McCabe | |
| 3,888,492 | A | * | 6/1975 | Cabot | 473/255 |
| 3,923,308 | A | * | 12/1975 | Mills | 473/254 |
| D244,303 | S | * | 5/1977 | Cabot | D21/739 |
| 4,032,156 | A | | 6/1977 | Clarke | |
| D247,585 | S | * | 3/1978 | Duclos | D21/744 |
| 4,128,244 | A | | 12/1978 | Duclos | |
| 4,136,877 | A | * | 1/1979 | Antonious | 473/254 |
| 4,343,472 | A | | 8/1982 | Hamilton | |
| 4,458,900 | A | * | 7/1984 | Antonious | 473/254 |
| 4,461,482 | A | * | 7/1984 | Bojicic | 473/254 |
| 4,722,528 | A | * | 2/1988 | Tsao | 473/254 |
| 4,988,107 | A | | 1/1991 | Sasse | |
| D325,950 | S | * | 5/1992 | Duran | D21/744 |
| D354,104 | S | * | 1/1995 | Hardy | D21/739 |
| D360,008 | S | * | 7/1995 | Solheim | D21/738 |
| 5,538,249 | A | * | 7/1996 | Benson | 473/254 |

(Continued)

OTHER PUBLICATIONS

EP Search Report, Application No. 08100969.8-2318, dated Aug. 25, 2008, pp. 1-4.*

*Primary Examiner*—Sebastiano Passaniti
(74) *Attorney, Agent, or Firm*—Michael Best & Friedrich LLP

(57) ABSTRACT

A golf club comprising: a shaft; a head affixed to a distal end of the shaft and having a ball striking face, the head comprising spaced apart lower and upper portions which have respectively: lower and upper primary alignment guides extending substantially perpendicular to the ball striking face, the lower primary alignment guide provided by at least one lower slot portion in the lower portion and the upper primary alignment guide provided by at least one upper slot portion in the upper portion; and lower and upper secondary alignment guides extending substantially parallel to the ball striking face, the lower secondary alignment guide provided by at least one further lower slot portion in the lower portion and the upper secondary alignment guide provided by at least one further upper slot portion in the upper portion, the primary and secondary alignment guides being positioned relative to one another so that a golfer's eyes are correctly aligned relative to the golf club head when the primary and secondary alignment guides are respectively perceived as being superposed.

12 Claims, 4 Drawing Sheets

U.S. PATENT DOCUMENTS 5,628,694 A * 5/1997 O'Connor, Jr. ..... 473/157
5,913,731 A * 6/1999 Westerman ..... 473/251
5,921,868 A * 7/1999 DiMartino ..... 473/254
6,062,986 A * 5/2000 Kaise ..... 473/242
7,052,409 B2 * 5/2006 Goldsmith ..... 473/242
7,226,362 B1 * 6/2007 Schell et al. ..... 473/238
7,244,189 B1 * 7/2007 Stobbe ..... 473/313
7,341,526 B2 * 3/2008 McCarthy ..... 473/251
7,485,047 B2 * 2/2009 Evans ..... 473/249
2004/0147334 A1 7/2004 D'Agguano
2004/0266542 A1 12/2004 Goldsmith

* cited by examiner

GOLF CLUB

RELATED APPLICATION

This application claims benefit of U.S. Patent Application No. 60/912,212 filed on Apr. 17, 2007 the entire disclosure of which is incorporated herein by reference.

FIELD OF THE INVENTION

The present invention relates to a golf club with means to assist a golfer to align their head relative to the golf club.

BACKGROUND TO THE INVENTION

A crucial part of the game of golf is for the golfer to align the golf club correctly. This is particularly crucial in putting as small errors in alignment can translate to errors that are significant enough for the golf ball to miss the hole. It is often suggested that when putting a player should align themselves with their eyes directly over the ball and hence also directly over the middle of the putter so that the player can more easily monitor striking the ball along the correct putting line—that is, the line from which the ball must leave the club if it is to go into the hole when struck at the correct pace.

It would be useful to provide a golf club which assists a golfer to align their eyes relative to the club head.

SUMMARY OF THE INVENTION

The invention provides a golf club comprising:

a shaft;

a head affixed to a distal end of the shaft and having a ball striking face, the head comprising spaced apart lower and upper portions which have respectively:

lower and upper primary alignment guides extending substantially perpendicular to the ball striking face, the lower primary alignment guide provided by at least one lower slot portion in the lower portion and the upper primary alignment guide provided by at least one upper slot portion in the upper portion; and lower and upper secondary alignment guides extending substantially parallel to the ball striking face, the lower secondary alignment guide provided by at least one further lower slot portion in the lower portion and the upper secondary alignment guide provided by at least one further upper slot portion in the upper portion, the primary and secondary alignment guides being positioned relative to one another so that a golfer's eyes are correctly aligned relative to the golf club head when the primary and secondary alignment guides are respectively perceived as being superposed.

In an embodiment, the secondary alignment guides are perpendicular to the primary alignment guides.

In an embodiment, the golf club is a putter and the alignment guides are located so that the golfer perceives they are superposed when the golfer's eyes are directly over the centre of the golf club head.

In an embodiment, the slot portions are provided by cross-shaped slots.

In an embodiment, the upper and lower portions are joined by at least one arcuate portion.

In an embodiment, the upper and lower portions are joined by a pair of spaced apart arcuate portions.

In an embodiment, the upper and lower portions define therebetween a pair of open sides to allow light to penetrate into the interior of the head.

In another aspect, the invention provides s golf club head adapted to be affixed to a distal end of a shaft and having a ball striking face, the head comprising spaced apart lower and upper portions which have respectively:

lower and upper primary alignment guides extending substantially perpendicular to the ball striking face, the lower primary alignment guide provided by at least one lower slot portion in the lower portion and the upper primary alignment guide provided by at least one upper slot portion in the upper portion; and lower and upper secondary alignment guides extending substantially parallel to the ball striking face, the lower secondary alignment guide provided by at least one further lower slot portion in the lower portion and the upper secondary alignment guide provided by at least one further upper slot portion in the upper portion, the primary and secondary alignment guides being positioned relative to one another so that a golfer's eyes are correctly aligned relative to the golf club head when the primary and secondary alignment guides are respectively perceived as being superposed.

In another aspect, the invention provides a golf club comprising:

a shaft;

a head affixed to a distal end of the shaft and having a ball striking face, the head being solid and comprising spaced apart lower and upper portions, the head having at of at least one slot extending through at least substantially all of the head such that the upper opening and the bottom of the slot provide lower and upper alignment guides extending substantially perpendicular to the ball striking face; and the head having lower and upper secondary alignment guides extending substantially parallel to the ball striking face and provided by the same slot or a further slot.

In an embodiment, the golf club comprises a single slot providing both primary and secondary alignment guides.

In an embodiment, the slot or slots extend through at least 75% of the head.

In an embodiment, the slot or slots extend completely through the head such that the bottom of the slot or slots are openings which provide the lower alignment guides.

In another aspect, the invention provides a golf club head adapted to be affixed to a distal end of a shaft and having a ball striking face, the head being solid and comprising spaced apart lower and upper portions, the head having at of at least one slot extending through at least substantially all of the head such that the upper opening and the bottom of the slot provide lower and upper alignment guides extending substantially perpendicular to the ball striking face; and the head having lower and upper secondary alignment guides extending substantially parallel to the ball striking face and provided by the same slot or a further slot.

BRIEF DESCRIPTION OF THE DRAWINGS

Embodiments of the invention will now be described in relation to the accompanying drawings in which.

DESCRIPTION OF THE EMBODIMENTS

Figure 1:
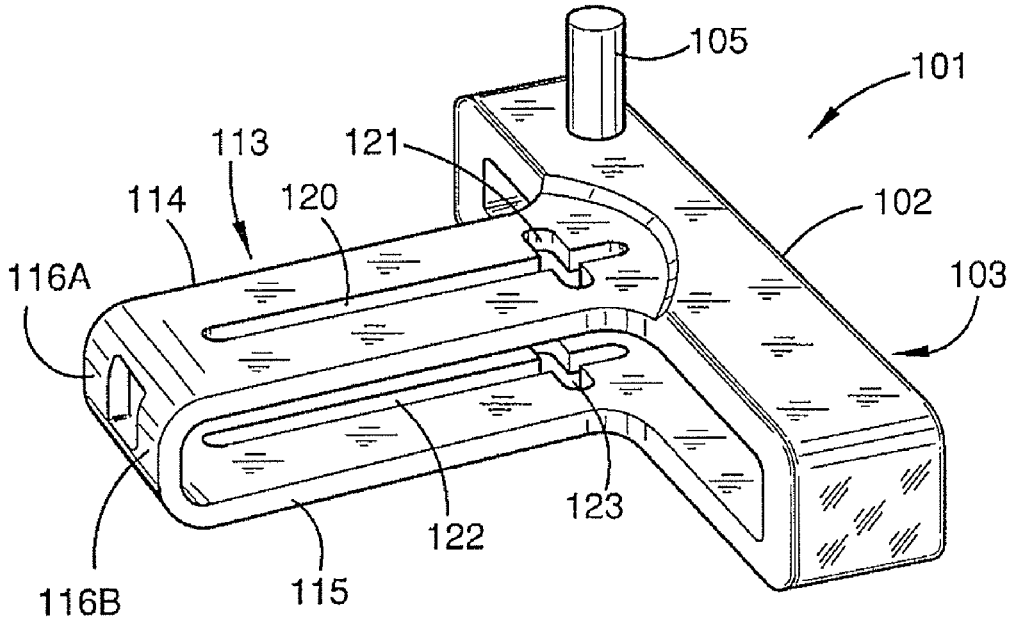
FIG. 1 is a perspective view of a head of a putter golf club of the first embodiment.

FIG. 1 shows a putter 101 of a first embodiment. As in the first embodiment, the putter has a head 102 having a ball striking face 103. The putter has a hozzle 105 for mounting the putter head to a shaft (not shown). The proximal end of the golf club is not shown however persons skilled in the art will be familiar that such shafts are usually around 70 to 100 cm long and have a grip at the proximal end which the golfer holds in order to swing the club. The shaft may be longer if the putter is a "belly" or "broomstick" putter. Persons skilled in the art will appreciate that the shape of the hozzle can be varied in order to accommodate different shaft lengths.

The putter has a back portion 113 comprised of upper portion 114 and a lower portion connected by a pair of arcuate portions. An upper alignment guide is provided by upper slot 120 and lower alignment guide is provided by a lower slot 122. The upper and lower portions 114, 115 are sufficiently spaced and sized to provide an alignment mechanism at the expected distance from the player's eyes which will typically be in the order of 130 cm to 180 cm depending on the player's height and playing stance.

The upper and lower alignment guides provide primary and secondary alignment guides. The primary alignment guides extend substantially perpendicular to the ball striking face and are in the centre of the golf club where the player is meant to strike the ball so that a golfer's eyes are correctly aligned directly above the ball and the putter head when the golfer perceives only a single line.

When the slots are perceived by the player as superposed, the player should be able to see the ground below the putter by a line of sight from the upper slot through the lower alignment slot. The light to the eyes along the length of the alignment slot will also increase due to the unrestricted alignment of the upper and lower alignment slots. As can be seen, from FIG. 2, the slots 120, 122 are cross-shaped and the transverse portions 121, 123 provide the secondary alignment guides. The secondary alignment guides assist the player to align the putter at the correct angle of attack—i.e. so that the face 103 is angled correctly relative to the golf ball at the point of contact. Again, when the transverse portions 121,124 are correctly aligned the player should be able to perceive the ground through the transverse portions and the light to the eye will increase due to the unrestricted alignment through both upper and lower transverse slots.

The gaps in the side of the putter defined by the upper and lower portions 114 and the gap between the arcuate portions 116A, 116B allow light to penetrate into the interior of the putter. This allows the player to see the upper surface of the lower portion 115 when the slots are not aligned and the primary and secondary slots appear darker. This helps the player to re-align the putter.

Persons skilled in the art will appreciate that the cruciform shaped slit in both upper and lower surfaces, gives a dual sighting plane when the eye is directly perpendicular to them. Under the principle of parallax, only when the player lifts the putter head slightly off the ground and moves the eye directly perpendicular to both slits may light be sighted clear through both upper and lower slits, ensuring the head is directly over the centreline and front of the putter, in the preferred position to execute the putting stroke.

Figure 2:
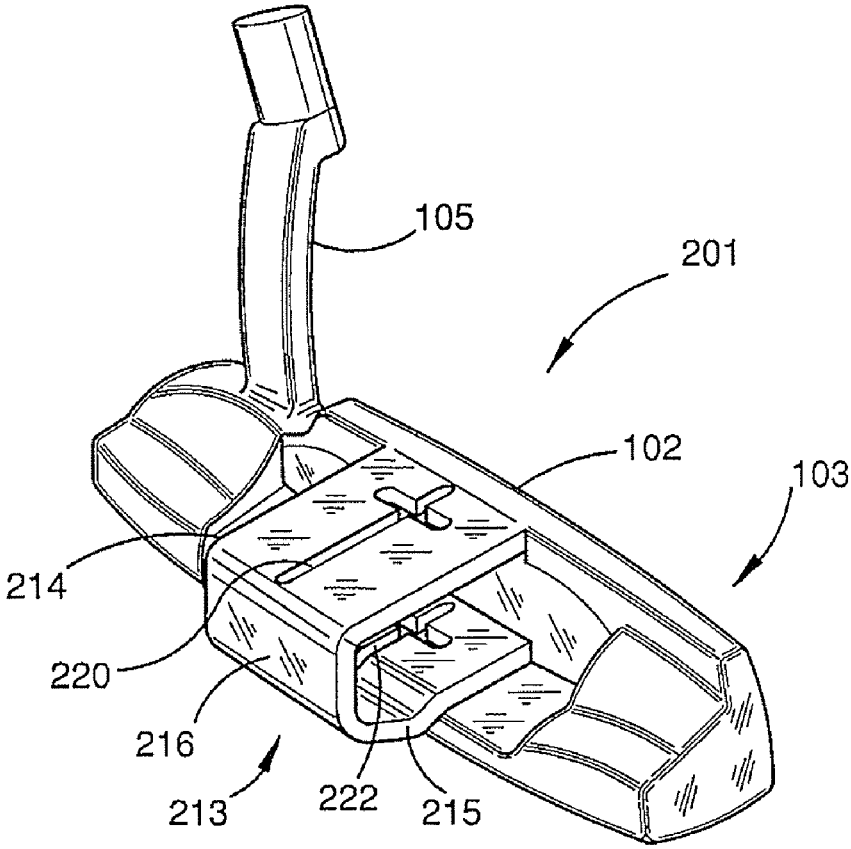
FIG. 2 is a perspective view of a golf club head of a second embodiment.

FIG. 2 shows an alternative embodiment, where the putter 201 has a shorter back portion 213 comprised of upper portion 214 and a lower portion connected by a single arcuate portion 216. An upper alignment guide is provided by upper cruciform slot 220 and lower alignment guide is provided by a lower cruciform slot 222.

Persons skilled in the art will appreciate that a number of other variations can be made to the invention. For example, while the invention is ideally suited to putting where alignment of the eyes over the ball is crucial, it can be used with other clubs and can be used for other alignments other than one where the player's head is directly over the ball. One example of a club with which this alignment technique can be used is a specialist chipping club designed to play chip shots with a putting like stroke and where alignment of the head over or near to directly above the ball improves the golfer's prospects of playing a stroke correctly.

Persons skilled in the art will appreciate that putters of many different shapes may employ the technique used in the preferred embodiment in an analogous manner. In particular, application of the technique is not restricted to putters having a long back as in the illustrated embodiment.

Further, one or both of the upper and lower alignment slots, particularly the lower slot could be replaced by a set of smaller slots or a set of hole shaped slot portions. In another alternative, the primary and secondary alignment guides could be provided by separate slots space from one another rather than by the cruciform slots.

Figure 3A:
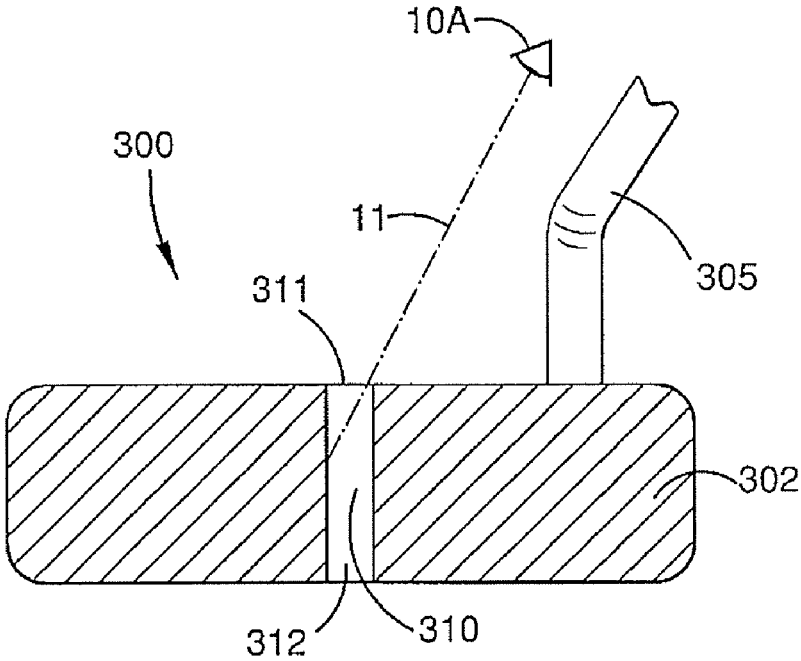
FIGS. 3A and 3B are cross-sections through a golf club head of a third embodiment.
Figure 3B:
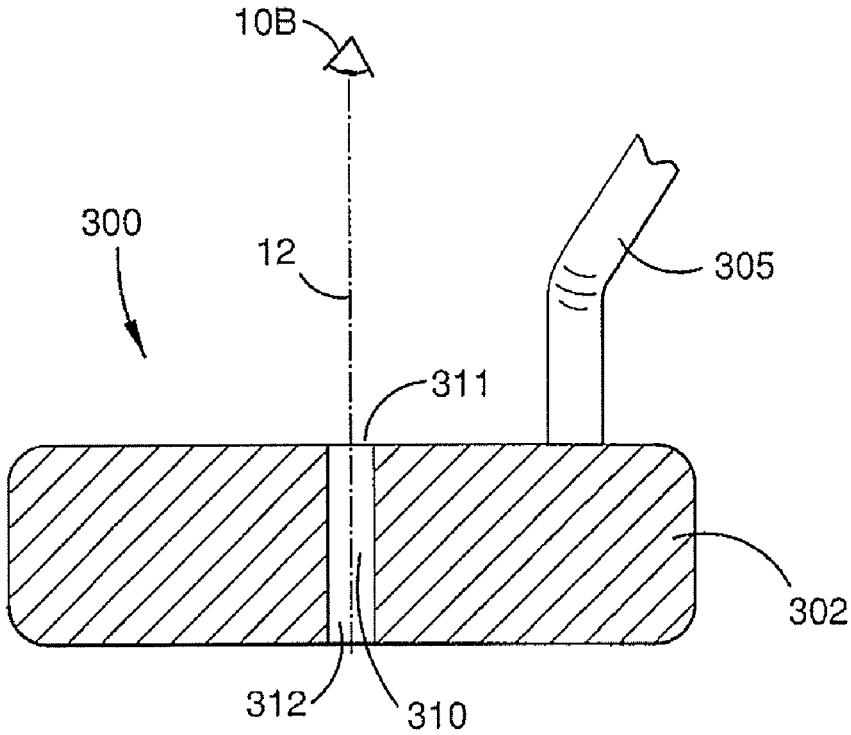

A third embodiment is shown in FIG. 3. Again the head 302 of a putting club 300 is shown connected to a hozzle 305 but a full shaft is not shown. In this embodiment, the head 302 is a solid head having a slot 310 extending completely through the head, which provides the alignment mechanism. As shown, in FIG. 3A, the player is unable to see the bottom opening 312 of slot 310 through upper opening 311 when the player's eye 10A is not over the aperture as indicated by line of sight 11 and hence the aperture appears dark. In contrast, in FIG. 3B, the player's eye 10B is directly over the alignment mechanism as indicated by line of sight 12 and the player is able to perceive the slot 310 as lighting up. It will be appreciated that the upper and lower openings 311, 312 have to be aligned and hence provide upper and lower primary alignment guides in an analogous manner to the first and second embodiments. Similar to the first and second embodiments a secondary alignment mechanism can be provided by a transverse aperture, which can be provided by making the aperture a cruciform.

Figure 4A:
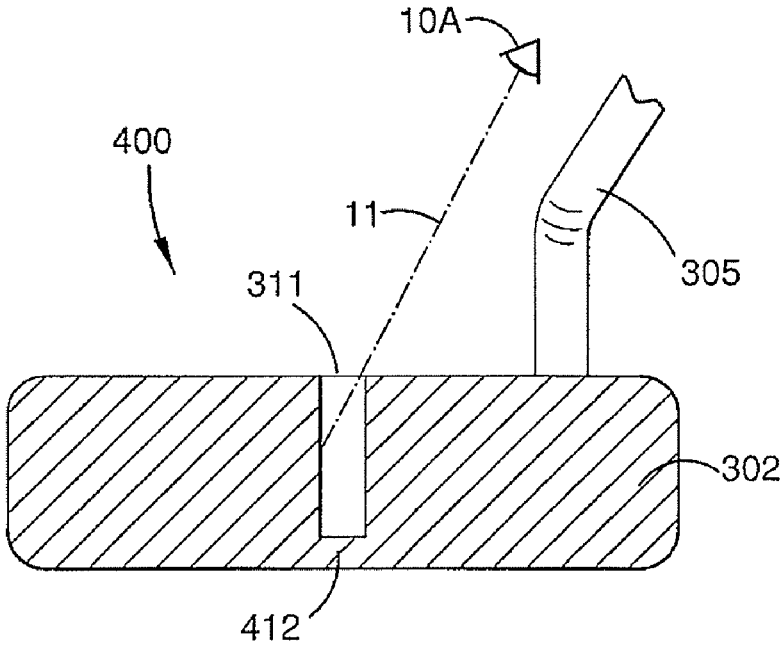
FIGS. 4A and 4B are cross-sections through a golf club head of a fourth embodiment.
Figure 4B:
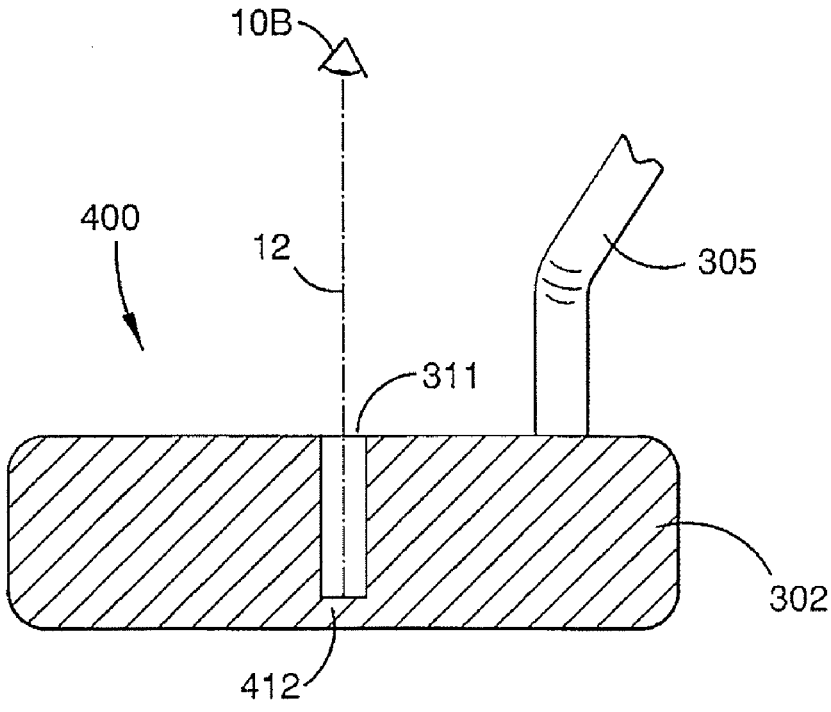

In the fourth embodiment of a putter head 400, shown in FIGS. 4A and 4B, slot 310 of FIG. 3 is replaced with longitudinal and transverse slots cut to a depth of approximately 75% of the depth of the putter head 400 to form deep slots with a machined, reflective transverse surface at the bottom 412 of the slots. As the eye 10B moves to the position shown in directly over the longitudinal and transverse slots the full width of the bottom 412 of the slots is reflected, thus achieving the correct longitudinal and transverse alignment.

Figure 5:
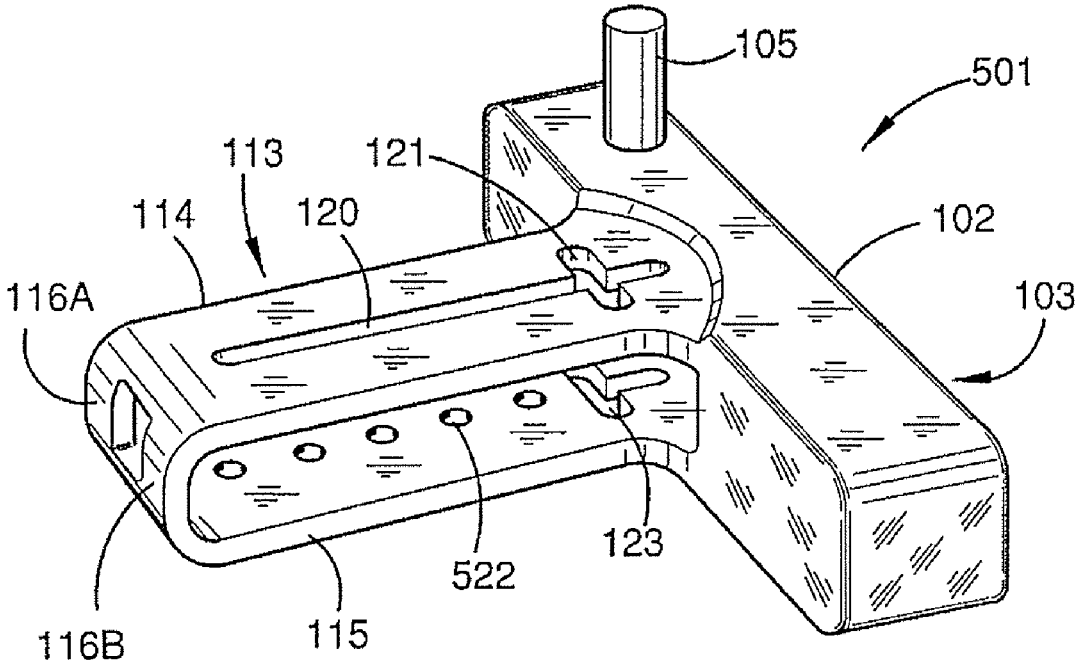
FIG. 5 is a perspective view of a golf club head of a fifth embodiment.

FIG. 5 shows a putter head 501 which is a variation on the first embodiment, the variation being that part of the primary, longitudinal, lower alignment guide is formed by a plurality of holes 522 along the lower portion 115 of the putter head. It will be appreciated that the holes 522 provide a plurality of slots.

Other modifications will be apparent to persons skilled in the art and should be considered as falling within the scope of the invention described herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A golf club comprising:

a shaft;

a head affixed to a distal end of the shaft and having a ball striking face, the head comprising spaced apart lower and upper portions defining a cavity therebetween and a pair of open sides to allow light to penetrate into the interior of the head, the lower and upper portions having:

lower and upper primary alignment guides extending substantially perpendicular to the ball striking face, the lower primary alignment guide provided by at least one lower slot portion extending through the lower portion and the upper primary alignment guide provided by at least one upper slot portion extending through the upper portion; and lower and upper secondary alignment guides extending substantially parallel to the ball striking face, the lower secondary alignment guide provided by at least one further lower slot portion extending through the lower portion and the upper secondary alignment guide provided by at least one further upper slot portion extending through the upper portion, the primary and secondary alignment guides being positioned relative to one another so that in an aligned position, the lower primary and secondary alignment guides are visible through the upper primary and secondary alignment guides.

2. A golf club as claimed in claim 1, wherein the secondary alignment guides are perpendicular to the primary alignment guides.

3. A golf club as claimed in claim 2, wherein the golf club is a putter.

4. A golf club as claimed in claim 1, wherein the slot portions are provided by cross-shaped slots.

5. A golf club as claimed in claim 1, wherein the upper and lower portions are joined by at least one arcuate portion.

6. A golf club as claimed in claim 5, wherein the upper and lower portions are joined by a pair of spaced apart arcuate portions.

7. A golf club as claimed in claim 1, wherein at least the lower primary alignment guide comprises a plurality of slot portions.

8. A golf club as claimed in claim 7, wherein the plurality of slot portions of the lower primary alignment guide comprises a plurality of holes.

9. A golf club as claimed in claim 1, wherein each upper slot portion is provided by an aperture in the upper portion and each lower slot portion is provided by an aperture in the lower portion.

10. A golf club head adapted to be affixed to a distal end of a shaft and having a ball striking face, the head comprising spaced apart lower and upper portions defining a cavity therebetween and a pair of open sides to allow light to penetrate into the interior of the head, the lower and upper portions having:

lower and upper primary alignment guides extending substantially perpendicular to the ball striking face, the lower primary alignment guide provided by at least one lower slot portion extending through the lower portion and the upper primary alignment guide provided by at least one upper slot portion extending through the upper portion; and lower and upper secondary alignment guides extending substantially parallel to the ball striking face, the lower secondary alignment guide provided by at least one further lower slot portion extending through the lower portion and the upper secondary alignment guide provided by at least one further upper slot portion extending through the upper portion, the primary and secondary alignment guides being positioned relative to one another so that in an aligned position, the lower primary and secondary alignment guides are visible through the upper primary and secondary alignment guides.

11. A golf club comprising:

a shaft;

a head affixed to a distal end of the shaft and having a ball striking face, the head comprising spaced apart lower and upper portions defining a cavity therebetween and a pair of open sides to allow light to penetrate into the interior of the head;

upper primary and secondary alignment guides formed by an upper cross-shaped aperture in the upper portion, the upper primary alignment guide extending substantially perpendicular to the ball striking face and the upper secondary alignment guide extending substantially parallel to the ball striking face; and lower primary and secondary alignment guides formed by a plurality of lower apertures in the lower portion, the primary alignment guide extending substantially perpendicular to the ball striking face and the lower secondary alignment guide extending substantially parallel to the ball striking face to the ball striking face, and wherein the primary and secondary alignment guides are positioned relative to one another so that in an aligned position, the lower primary and secondary alignment guides are visible through the upper primary and secondary alignment guides.

12. A golf club as claimed in claim 11, wherein the plurality of lower apertures comprise a plurality of circular holes.

* * * * *